US005657657A

United States Patent [19]

Welsh et al.

[11] Patent Number: 5,657,657

[45] Date of Patent: Aug. 19, 1997

[54] SPRING COILING MACHINE WITH HYBRID SERVO MOTOR-CAM TORSION CONTROL

[75] Inventors: Colin Welsh, Torrington; Todd E. Brink, Farmington, both of Conn.

[73] Assignee: BHS-Torin Inc., Farmington, Conn.

[21] Appl. No.: 556,737

[22] Filed: Nov. 7, 1995

[51] Int. Cl.[6] ..... B21F 3/10; B21F 3/04

[52] U.S. Cl. ..... 72/138; 72/145

[58] Field of Search ..... 72/135, 137, 138, 72/140, 142, 145, 429, 452.1, 452.4

[56] References Cited

U.S. PATENT DOCUMENTS

| | | | |
|---|---|---|---|
| 3,934,445 | 1/1976 | Lampietti | 72/138 |
| 4,026,135 | 5/1977 | Yagusic et al. | 72/142 |
| 4,934,165 | 6/1990 | Philpot et al. | 72/138 |
| 5,259,226 | 11/1993 | Itaya | 72/138 |
| 5,363,681 | 11/1994 | Speck et al. | 72/145 |

*Primary Examiner*—Lowell A. Larson
*Assistant Examiner*—Rodney A. Butler
*Attorney, Agent, or Firm*—McCormick, Paulding & Huber

[57] ABSTRACT

A spring coiling machine has a feed assembly with a servo motor for driving the feed rolls. Substantially all tooling including a coiling tool, a pitch tool and an auxiliary arbor are also servo motor operated with three axes of servo control including a "torsion" axis provided for the coiling tool. The auxiliary arbor has a plurality of wire forming positions and is also servo motor controlled. The "torsion" movement for the coiling tool is controlled by a servo motor-cam mechanism for accurate high speed operation with a high frequency of torsion movement of the coiling tool.

16 Claims, 12 Drawing Sheets

SPRING COILING MACHINE WITH HYBRID SERVO MOTOR-CAM TORSION CONTROL

BACKGROUND OF THE INVENTION

The present invention relates to a spring coiling machine of the general type which is adapted for the intermittent feeding of predetermined lengths of wire, the lengths of wire being coiled during feeding to form springs and the coiled wire being cut off on completion of coiling. While not necessarily so limited, the invention is particularly applicable in spring coiling and winding machines of the general type shown and described in:

U.S. Pat. No. 2,119,002, issued May 31, 1938 to Bergevin and Nigro.

U.S. Pat. No. 2,455,863, issued Dec. 7, 1948 to E. W. Hakvorsen.

U.S. Pat. No. 2,820,505, issued Jan. 21, 1958 to E. E. Franks et al.

U.S. Pat. No. RE24,345, issued Aug. 20, 1957 to C. R. Bergevin.

U.S. Pat. No. 2,902,079, issued Sep. 1, 1959 to Costello et al.

U.S. Pat. No. 2,923,343, issued Feb. 2, 1960 to Franks.

U.S. Pat. No. 2,925,115, issued Feb. 16, 1960 to Franks.

U.S. Pat. No. 3,009,505, issued Nov. 21, 1961 to Franks.

U.S. Pat. No. 3,068,927, issued Dec. 18, 1862 to Bergevin.

U.S. Pat. No. 3,402,584, issued Sep. 24, 1968 to Cavagnero.

U.S. Pat. No. 3,934,445, issued Jan. 27, 1976 to Lampietti.

U.S. Pat. No. 4,018,071, issued Apr. 19, 1977 to Yagusic et al.

U.S. Pat. No. 4,018,070, issued Apr. 19, 1977 to Lampietti.

U.S. Pat. No. 4,026,135, issued May 31, 1977 to Yagusic et al.

U.S. Pat. No. 4,030,327, issued Jun. 21, 1977 to Collins et al.

U.S. Pat. No. 4,387,585, issued Jun. 14, 1983 to Cavagnero et al.

U.S. Pat. No. 4,520,644, issued Jun. 4, 1985 to Lampietti.

U.S. Pat. No. 5,363,681, issued Nov. 15, 1994 to Speck et al.

More particularly, the invention relates to a spring coiling machine wherein wire feed, diameter, pitch, and certain coiling tool movements are effected directly with externally commutated AC brushless servo motors under the control of a microprocessor or the like, "torsion" movements of the coiling tool, however, being effected by a "hybrid" servo motor-cam mechanism for enhanced efficiency in high frequency "torsion" movement and control.

It is the general object of the present invention to provide a spring coiling machine which exhibits a high degree of efficiency in the high speed manufacture of springs and spring-like formed wire products requiring high frequency "torsion" movement and control.

A further object of the invention involves the provision of a hybrid servo motor-cam drive mechanism for effecting "torsion" movements of a coiling tool.

SUMMARY OF THE INVENTION

In fulfillment of the foregoing objects, a cyclically operable spring coiling or wire forming machine having a coiling or forming station is provided with a feed roll assembly which comprises at least one pair of oppositely rotatable feed rolls for cooperatively gripping wire therebetween and for advancing the same longitudinally to the coiling or forming station. A relatively fixed coiling arbor is preferably provided at the coiling station and has at least one associated coiling tool which is arranged to engage longitudinally advancing wire and to obstruct the linear movement thereof whereby progressively to bend the same about the coiling arbor and thus impart a coiling stress thereto resulting in the formation of a coil spring or other formed wire product at a leading end portion thereof. A cutting tool at the coiling station adjacent the coiling arbor operates to intermittently sever coiled or formed leading end portions of the wire whereby to provide individual coil springs or other formed wire products.

The aforementioned feed roll assembly may be of the conventional stationary type or, as shown and described herein, may be mounted for rotation about the axis of wire advanced by the feed rolls with a servo motor driving at least one of the feed rolls and supported by and rotatable with the feed roll assembly. A stationary servo motor for rotating the feed roll assembly operates in timed relationship with the advancement of the wire by the feed rolls and the formation of coil springs or other formed wire articles.

Preferably, and as is conventional, two (2) pairs of feed rolls are provided in adjacent relationship with at least one roll of each pair being driven by the servo motor and with at least one roll of each pair having an associated fluid cylinder means for urging the same in a generally perpendicular direction relative to the line of wire feed for gripping and releasing wire. As shown and described hereinbelow, gear means is provided in association with the servo motor whereby to drive all four feed rolls in unison from the servo motor with opposing feed rolls rotating in opposite directions. At least one guide means is also provided for the passage of wire therethrough in association with the feed rolls.

The coiling tool is mounted for movement along an "axis" generally toward and away from the coiling arbor and substantially along a forwardly extended wire feed line. A servo motor for controlling such movement of the coiling tool during formation of a coil spring or other formed wire article may be under the control of a microprocessor or the like.

A pitch tool is also provided at the coiling station and may be conventional in operation, engaging the wire during longitudinal advancement thereof to displace the same laterally and thus to create and control "pitch" in the coiling of a spring. The pitch tool is also mounted for movement along an "axis" and in a direction generally perpendicular to the line of wire advancement. A servo motor is provided for controlling the movement of the pitch tool under the control of a microprocessor or the like.

The coiling tool is also mounted for movement in two directions generally perpendicular to each other and both generally perpendicular to the wire feed line. Two (2) additional servo motors are provided for respectively controlling coiling tool movement along the "axes" perpendicular to the wire feed line, movement in the "torsion" direction being controlled by a servo motor-cam mechanism as aforesaid.

Still another feature which may be included in the spring coiling machine is an auxiliary arbor which is moveable between inoperative and operative positions in a direction generally perpendicular to but displaced slightly in a lateral direction from the line of wire feed movement. The arbor is disposed in an operative position adjacent to and on one side of wire residing along the line of wire feed and provides lateral resistance, or may be said to act as an anvil for bending of the wire thereabout by a coiling tool. The latter is disposed on an opposite side of the wire and is moveable laterally across the wire line toward the arbor. A servo motor for moving the arbor between its inoperative and operative positions is provided and is also adapted to move the arbor to a plurality of operative positions along its length to effect different wire bending operations.

With the exception of the coiling tool "torsion" movement, the coiling machine as thus far described forms the subject matter of co-pending U.S. patent application Ser. No. 08/543,259, filed Oct. 18, 1995, and entitled IMPROVED SPRING COILING MACHINE, hereby incorporated herein by reference. For further detailed description and illustration, reference may be had to the application.

DESCRIPTION OF PREFERRED EMBODIMENT

In the specification hereinbelow and in the claims which follow, various terminology which is directional, geometrical, and/or spacial in nature such as "longitudinal", "horizontal", "front", "rear", "upwardly", "downwardly", etc. is employed. It is to be understood that such terminology is used for ease of description and in a relative sense only and is not to be taken in any way as a limitation upon the scope of the present invention.

Figure 1:
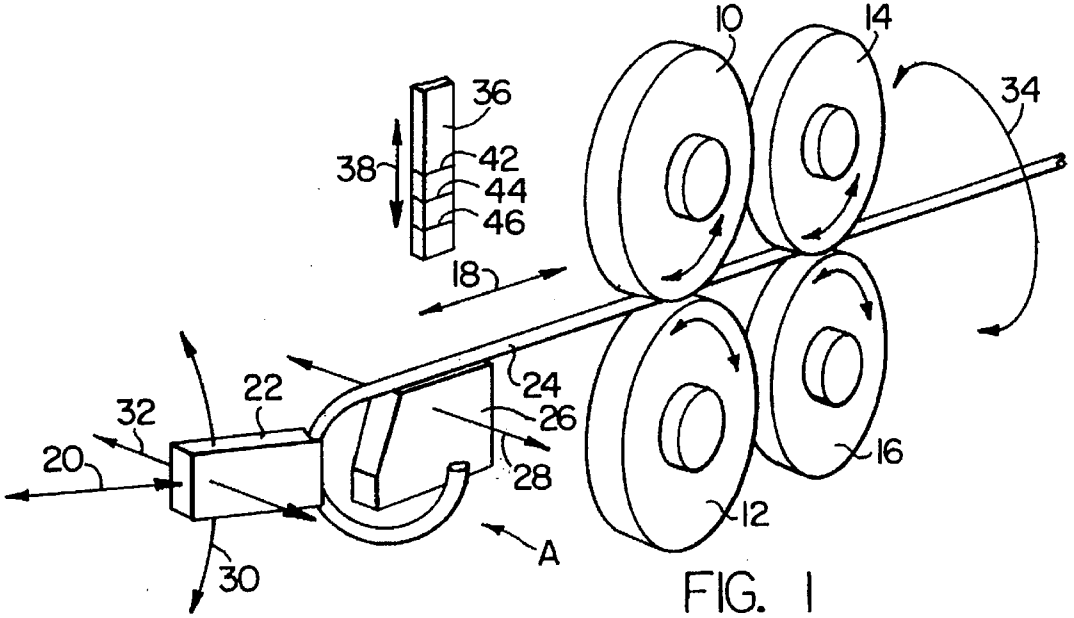
FIG. 1 is a perspective view in schematic form illustrating a coiling station of the spring coiling machine of the present invention with arrows indicating tool movement along seven (7) "axes".

Referring now particularly to FIG. 1, it will be observed that a first pair of feed rolls 10,12 cooperatively engage wire therebetween and rotate in opposite directions whereby to feed the wire downwardly and leftwardly in FIG. 1. A second pair of feed rolls 14,16 similarly grip wire therebetween and urge the same leftwardly and downwardly toward coiling station A in FIG. 1. Arrows 18 represent a first "axis" of movement, in this instance a rate of feed or advancement of the wire downwardly and leftwardly in FIG. 1. With the feed rolls 10–16 controlled by a servo motor under the direction of a microprocessor or the like, the rate of wire feed or advancement can of course be varied and controlled as required in the formation of a coil spring or other formed wire article. Further, the wire may be advanced, stopped, perhaps retracted, and servo controlled in all respects as indicated by the arrows 18 during the formation of the spring or other article.

A second "axis" of control is represented by arrows 20 associated with coiling tool 22 and, as will be apparent, the axis 20 refers to movement or positioning of the coiling tool toward and away from wire 24 and, more particularly, substantially along a line of wire feed. As will be seen, the diameter of coil springs formed by the coiling tool 22 may be varied over the length of the spring by appropriate servo controlled movement of the tool along the axis 20. Further, the coiling tool 22 may be moved and controlled along fourth and filch "axes" as will be described more fully hereinbelow.

Pitch tool 26 which may have a grooved upper surface engaging wire 24, displaces the same forwardly in FIG. 1 whereby to provide for and control the "pitch" of a coil spring. Arrows 28 represent a third "axis" whereby the pitch tool 26 is mounted for movement in the direction of the arrows, that is, laterally and substantially horizontally relative to the line of wire feed. Through movement in the direction indicated by a servo motor in turn under the control of a microprocessor or the like, the pitch of a coil spring may be varied, for example, throughout the length of the spring with different sections of the spring having different pitch characteristics..

The arrows 30 represent "torsion" or fourth "axis" control and, as will be apparent, a shallow substantially vertical arcuate movement is provided for as a convenience in design and construction, precisely vertical linear movement also falling within the scope of the invention. Movement in the direction of the arrows 30 is of course in a lateral or perpendicular direction with respect to the line of wire feed and also with respect to the axis of a coil spring formed at the coiling station A. The movement indicated is employed in the formation of "torsion" springs, "belt" and "magazine" springs and other formed wire articles, as will be described more fully hereinbelow.

Arrows 32 represent a second perpendicular movement of the coiling tool which, in the case of coil spring formation, is substantially parallel with the axis of the spring. Such movement may be regarded as a fifth "axis" under servo motor control and may be employed in the formation of coil springs having special end or tail formations and other formed wire articles.

Arrows 34 represent a sixth "axis" of control, more specifically, rotation of the feed roll assembly as mentioned above with the wire 24 being rotated thereby. Rotation may occur in one and opposite directions about the axis of the wire during formation of a coil spring or other article, and rotation may also be stopped, started, reversed, etc. Control of such operation is exercised by the aforementioned servo motor carried by the feed roll assembly and a microprocessor or the like operatively associated with the servo motor. "Reverse" or "double bodied" torsion springs and other formed articles can be formed with the aid of rotation of the wire feed assembly about the axis of the wire.

Auxiliary arbor 36, moveable vertically as indicated by arrows 38, represents a seventh "axis" of control. As better illustrated in FIG. 1A the auxiliary arbor may be moved downwardly into position laterally adjacent wire 24 and in front of the wire relative to the line of wire feed. Thereafter, coiling tool 22, having been retracted laterally rearwardly to allow a leading end portion 40 of the wire to be advanced thereby, may be moved forwardly engaging the wire portion 40 and employing the arbor 36 as an anvil in bending the wire thereabout.

Figure 1A:
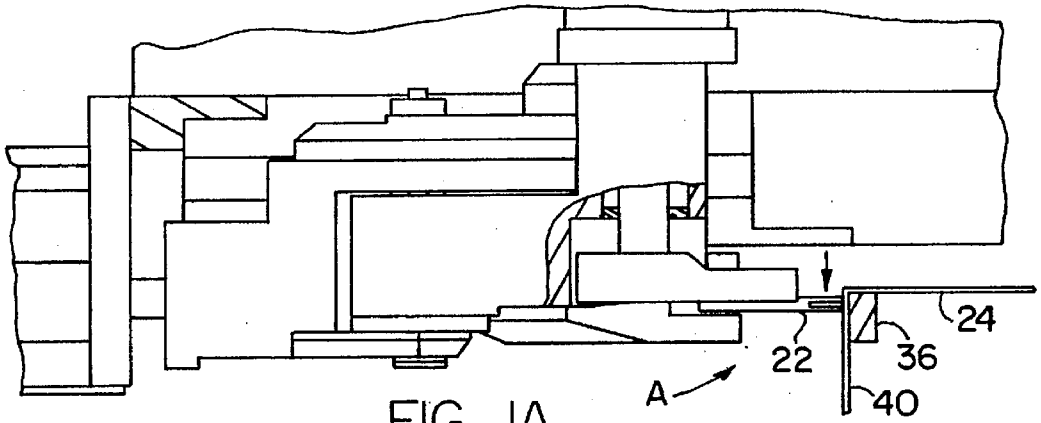
FIG. 1A is a fragmentary schematic view illustrating operation of the auxiliary arbor of the spring coiling machine.

The arbor 36 is moved upwardly and downwardly between operative and inoperative positions by an associated servo motor and has a plurality of operative positions indicated respectively at 42, 44, and 46 along the length thereof. Thus, a sharp right hand bend may be provided for example as illustrated in FIG. 1A with perhaps a shallow 45° bend at position 44 or a bend on a radius at the position 46. The auxiliary arbor may be employed, for example, in the formation of coil springs and other formed articles having specific bending requirements at end or tail portions.

Figure 2:
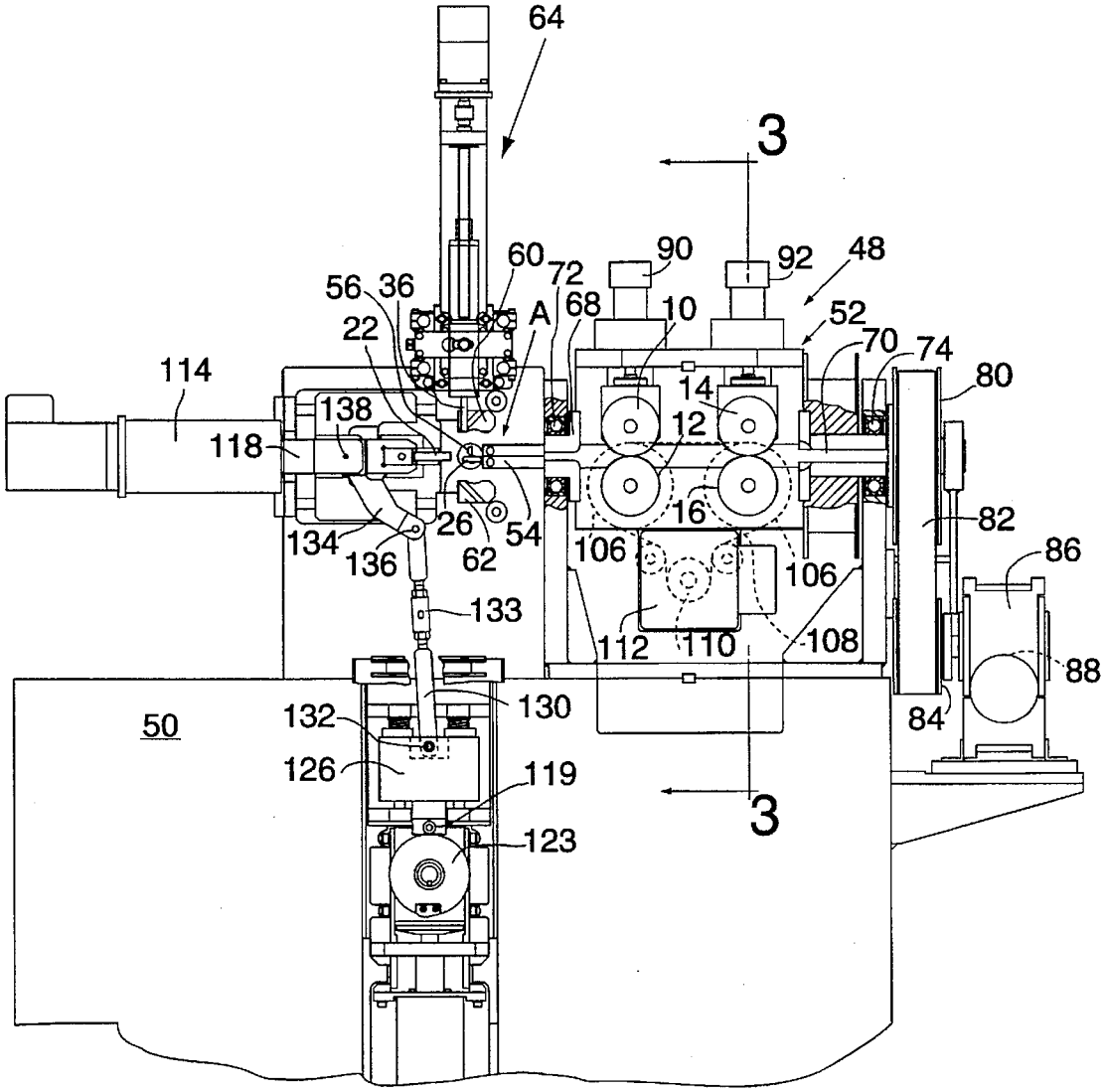
FIG. 2 is an enlarged fragmentary front view of the spring coiling machine of the invention showing a coiling station, feed and guide means, a coiling tool, a pitch tool, and various other tools and servo motors therefore.

Referring now particularly to FIG. 2, it will be observed that a spring coiling machine indicated generally at 48 comprises an upstanding main supporting frame or housing 50. At a front and right hand portion of the frame or housing 50, a feed assembly indicated generally at 52 is provided for intermittently advancing spring wire in a horizontal and longitudinal direction, leftwardly in FIG. 2. The feed assembly 52 includes conventional feed rolls 10, 12, and 14,16 with the wire passing first through the rolls and thereafter through a conventional wire guide means 54 to the coiling station A. At the coiling station A a small arbor 56, which may form a part of pitch tool 26, may be provided, and projects laterally and generally horizontally forwardly so as to be engaged laterally by the wire which is advanced longitudinally leftwardly through the guide means 54 by the feed rolls 10–16. As will be apparent, various sizes of arbors may be provided and adjustment of arbor position for coiling and or cut off may be provided for in a conventional manner.

Coiling tool 22 is positioned along the line of wire feed so as to be engaged by the wire as it advances leftwardly and serves to cause the wire to be coiled in a conventional manner as described above. Movement of the coiling tool 22 along the various axes mentioned above is provided for by associated servo motor mechanisms described hereinbelow.

Upper and lower cut off tools 60,62 at the coiling station A may be conventional in construction and operation and, as will be apparent, the tools can be swung toward and away from the arbor 56 for severing a spring or the like from an end portion of the wire after formation of the same. Left and right hand springs as well as a wide variety of formed articles can be accommodated by the cut off tools.

As mentioned above, a pitch tool 26 is also provided at the coiling station A and may be conventional in construction and operation. The pitch tool engages the wire laterally in a grooved portion as mentioned and displaces the wire laterally whereby to "pitch" a spring. Movement of the pitch tool horizontally toward and away from the viewer in FIG. 2 is provided for as mentioned above by an associated servo motor mechanism described more fully hereinbelow.

In addition to the aforementioned more or less conventional tooling at the coiling station A, there may also be provided an auxiliary arbor mechanism as indicated generally at 64. An arbor 36 is moveable vertically in FIG. 2 between operative and inoperative positions, with the retracted or inoperative position shown in FIG. 2. In its operative position, better illustrated in FIG. 1A, the arbor cooperates with the coiling tool 22 in a wire bending operation as described.

Figure 3:
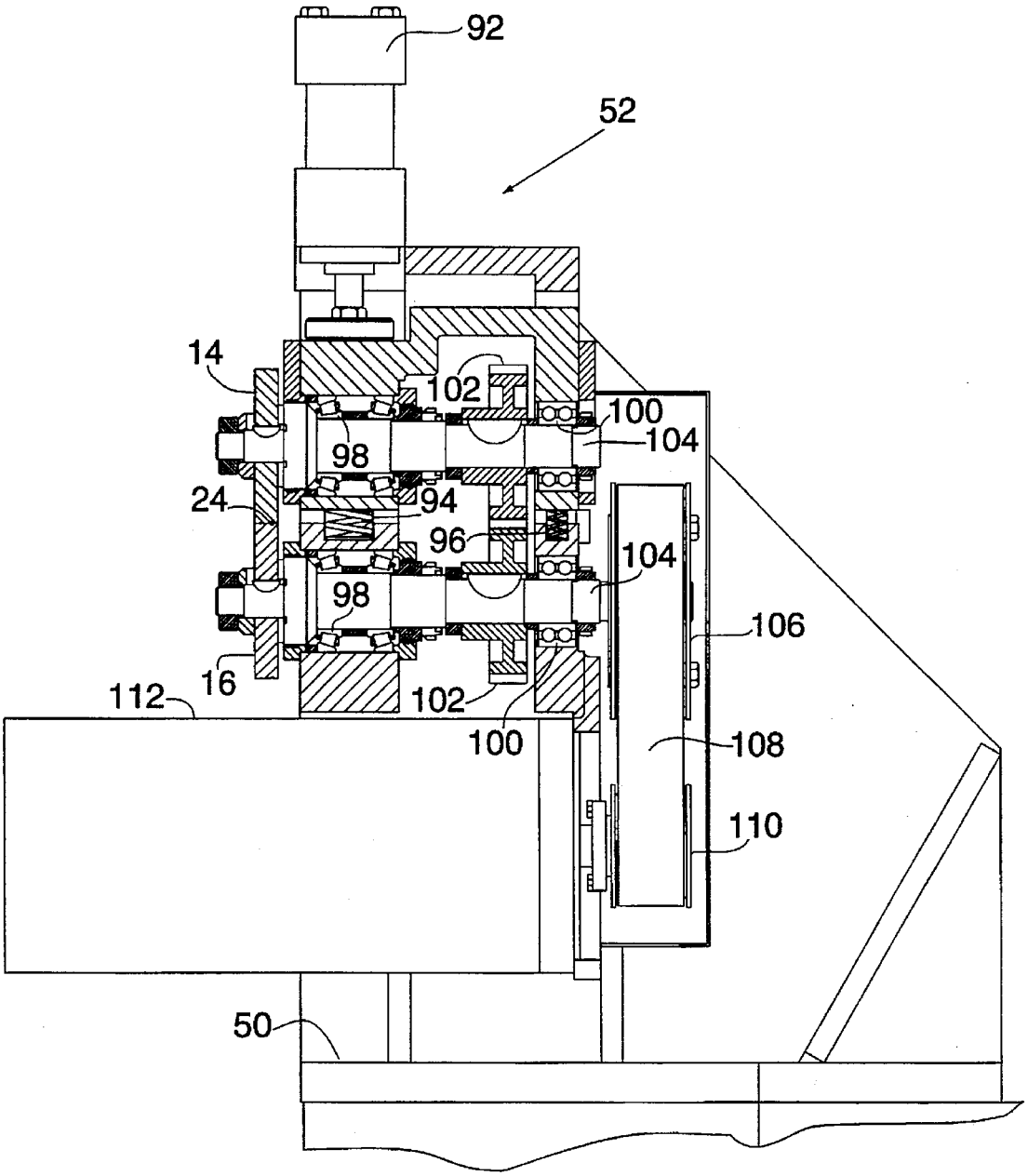
FIG. 3 is an enlarged fragmentary sectional view taken generally as indicated at 3,3 in FIG. 2 showing the feed roll assembly.
Figure 4:
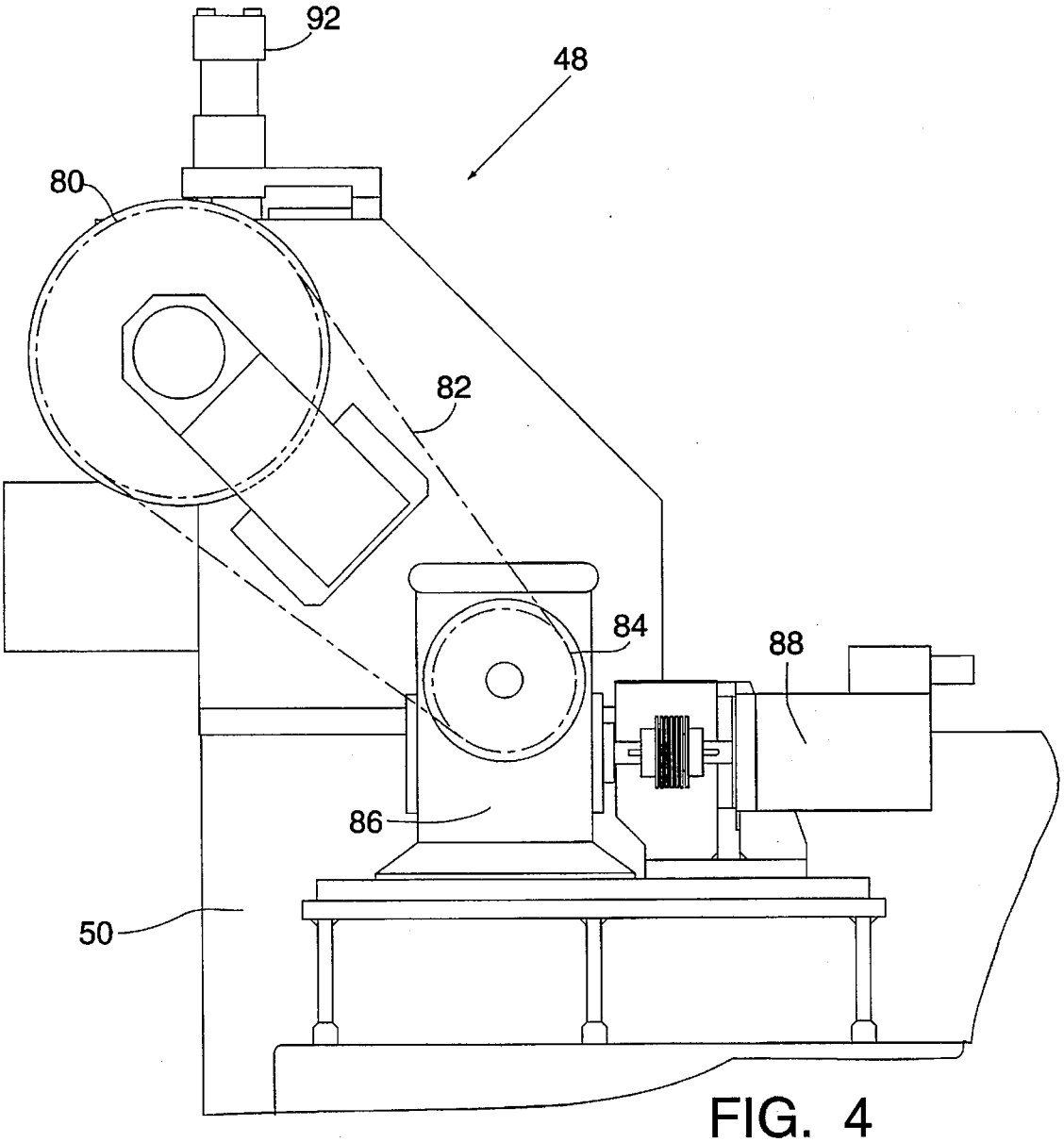
FIG. 4 is an enlarged fragmentary end view of the feed roll assembly and drive means for rotating the same.

Referring now to FIGS. 2, 3, and 4, it will be observed that the rotary feed assembly 52 is supported by hollow stub shafts 68 and 70 respectively at left and right hand end portions in FIG. 2 and journaled in bearings 72,74. The right hand stub shaft 70 is driven by a pulley 80, FIGS. 2 and 4, in turn driven by a cog belt 82 or the like extending from a smaller pulley 84. The pulley 84 is driven through a speed reducer 86 from a servo motor 88, FIG. 4.

Referring particularly to FIGS. 2 and 3, it will be observed that fluid cylinder means 90 and 92 are provided in association with the first and second pairs of feed rolls 10, 12, and 14,16, respectively. As better illustrated in FIG. 3 back-up springs 94,96 are provided for urging the feed rolls relatively apart while the fluid cylinder means, hydraulic cylinders in preferred form, urge the feed rolls together to grip the wire 24 therebetween. As will be apparent, the fluid cylinders 90,92 may be operated selectively under the control of a microprocessor or the like to cause the feed rolls to grip and release wire as required in a wire feeding operation.

Each of the feed rolls 14 and 16 shown in FIG. 3 has associated front end rear bearings respectively at 98 and 100 with a gear 102 fixedly mounted on and driving a feed roll shaft 104. The feed rolls 10,12 are provided with similar drive shafts journaled at front and rear bearings and with gears fixedly mounted thereon as with the gears 102,102. Lowermost drive shafts 104,104, associated respectively with feed rolls 12 and 16, as best illustrated in FIG. 2, are driven by pulleys 106,106 and an associated cog belt 108. The cog belt 108 is in turn driven by a pulley 110 under the control of a servo motor 112.

Figure 5:
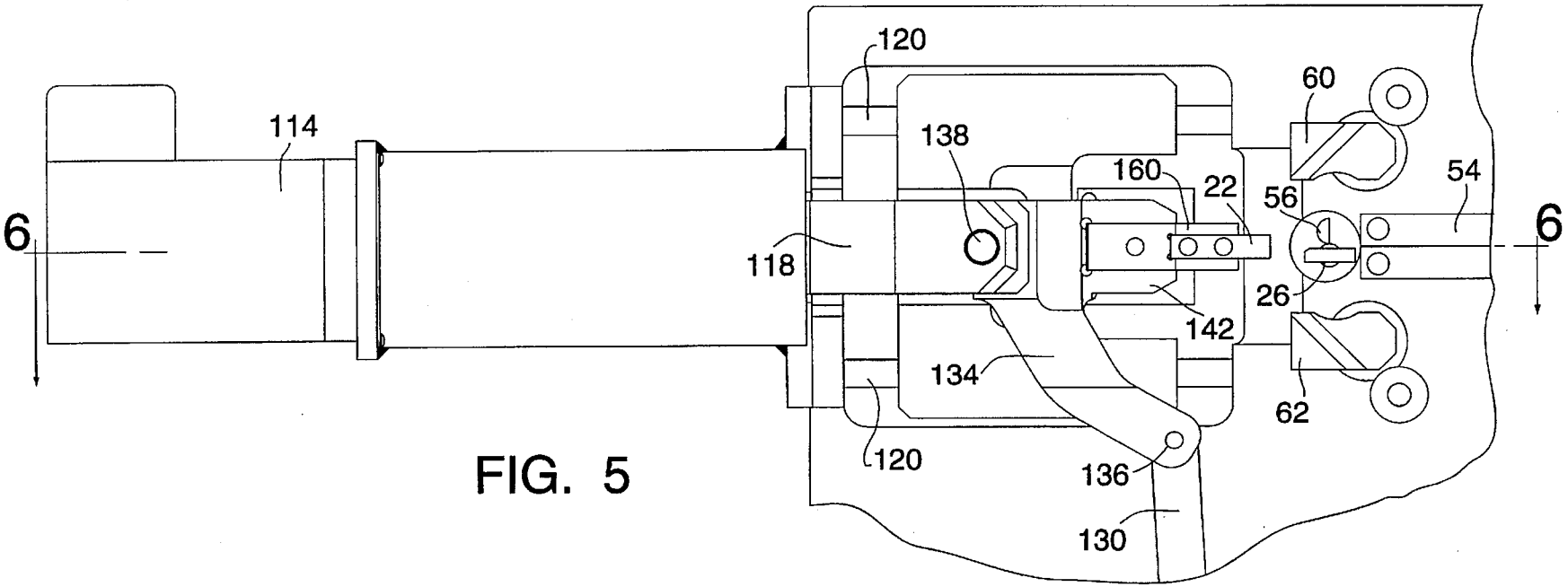
FIG. 5 is an enlarged fragmentary front view showing a coiling tool and operating means therefore including a servo motor for controlling the movement and position of the same along the line of wire feed.
Figure 6:
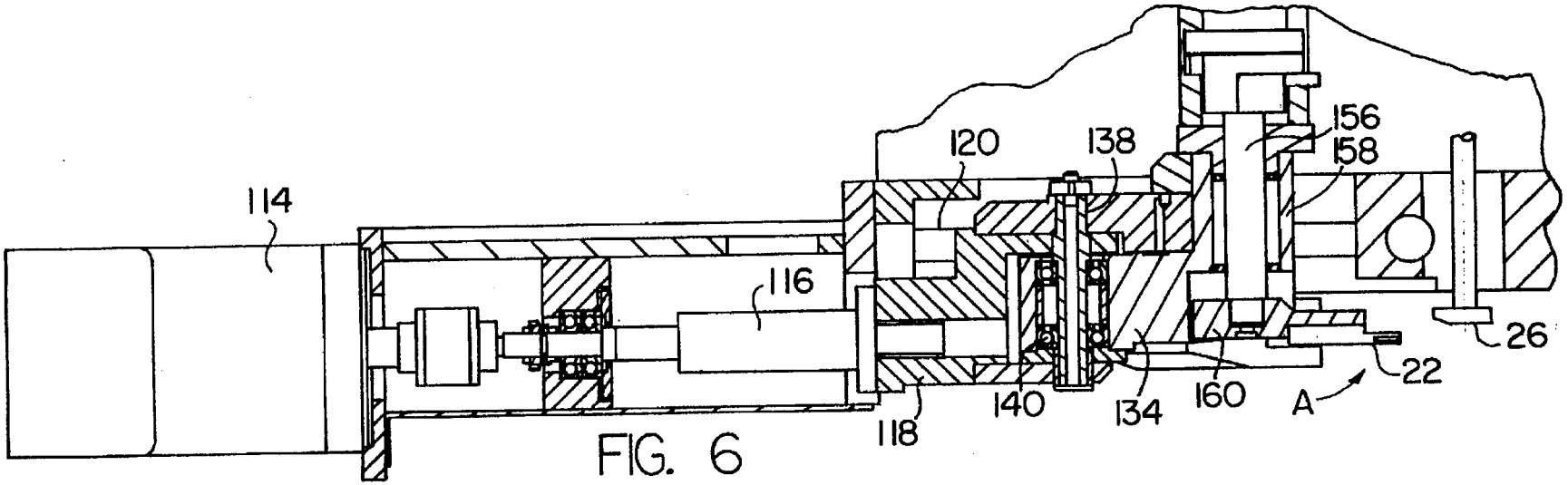
FIG. 6 is an enlarged fragmentary sectional view taken generally as indicated at 6,6 in FIG. 5 and showing the servo motor and associated elements controlling the position of the coiling tool along the line of wire feed together with portions of mechanism for moving the coiling tool in two (2) additional directions perpendicular to the line of wire feed, one of the latter being a "torsion" movement.
Figure 7:
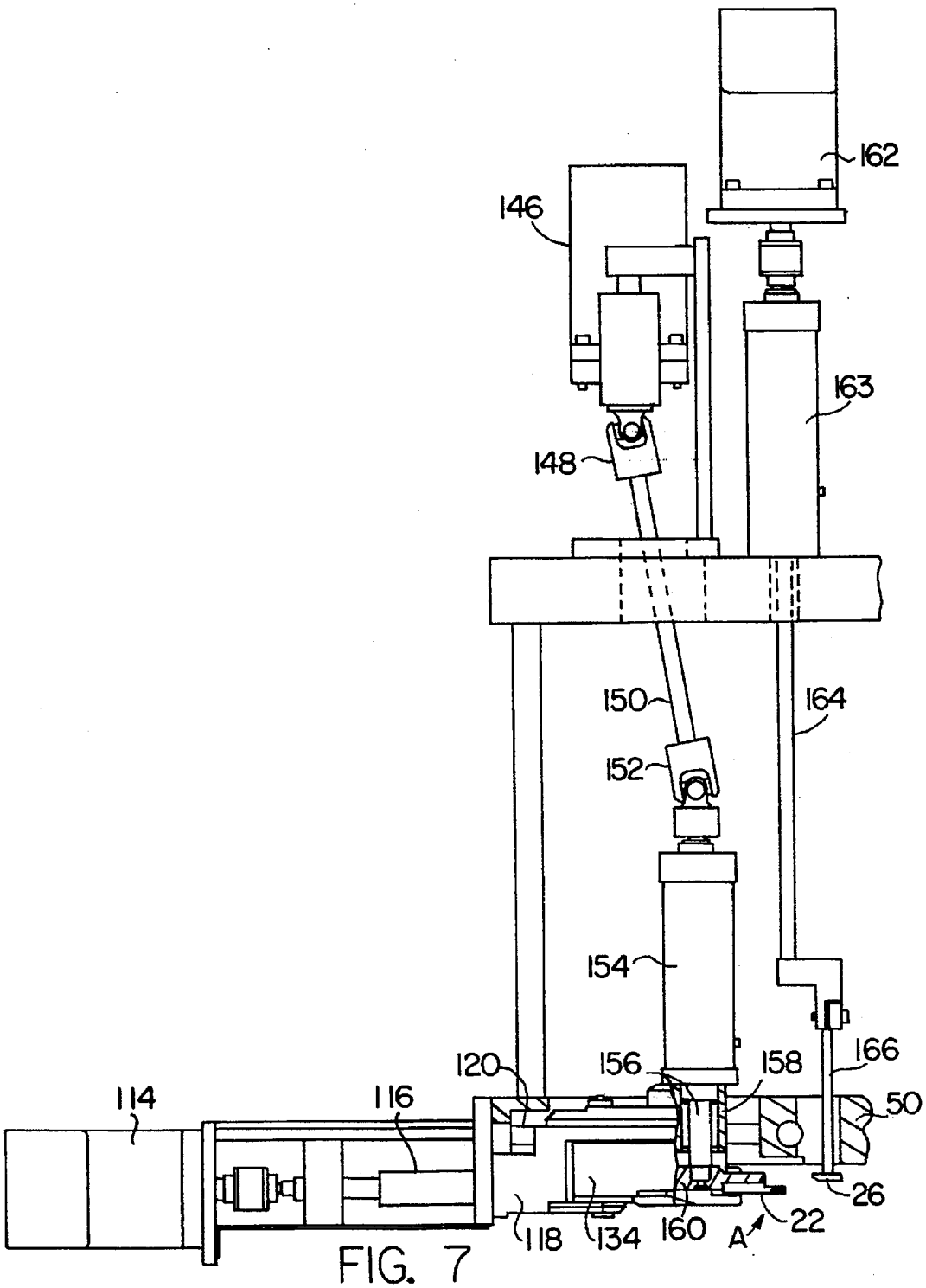
FIG. 7 is fragmentary enlarged view partially in section showing servo motors and associated elements for controlling movement of the coiling tool along one line of perpendicular movement and for controlling movement of the pitch tool.

In FIGS. 5, 6 and 7, a mechanism for moving and controlling operation of the coiling tool 22 is illustrated. Referring first to FIG. 6, servo motor 114 drives the input side of a preloaded ball screw mechanism 116 which converts from rotary to linear movement and which in turn drives a slide 118 mounted on guide rods 120, one shown. The coiling tool 22 is moveable leftwardly and rightwardly in FIG. 6 on similar movement of the slide 118 in a direction substantially along the line of wire feed. Thus, second "axis" movement and control is provided for as described above with reference to FIG. 1.

Figure 7A:
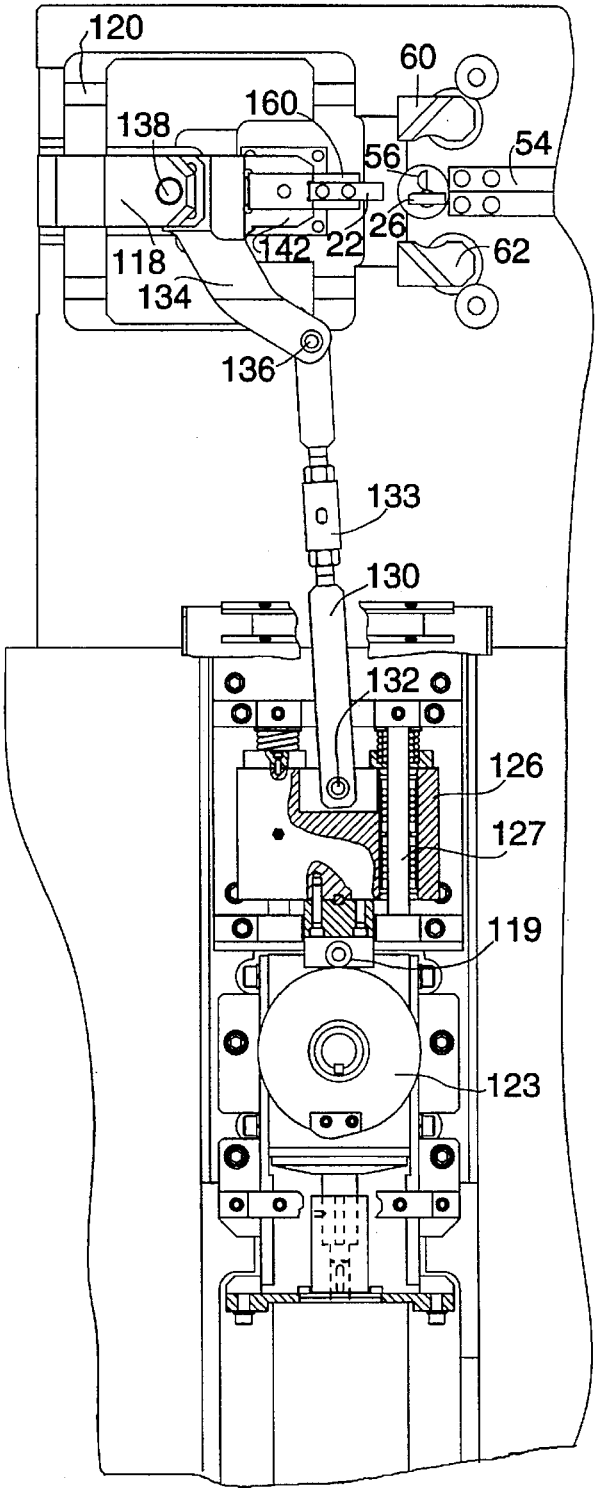
FIG. 7A is an enlarged fragmentary front view, partially in section and showing the servo motor-cam drive mechanism for "torsion" control and movement.
Figure 7B:
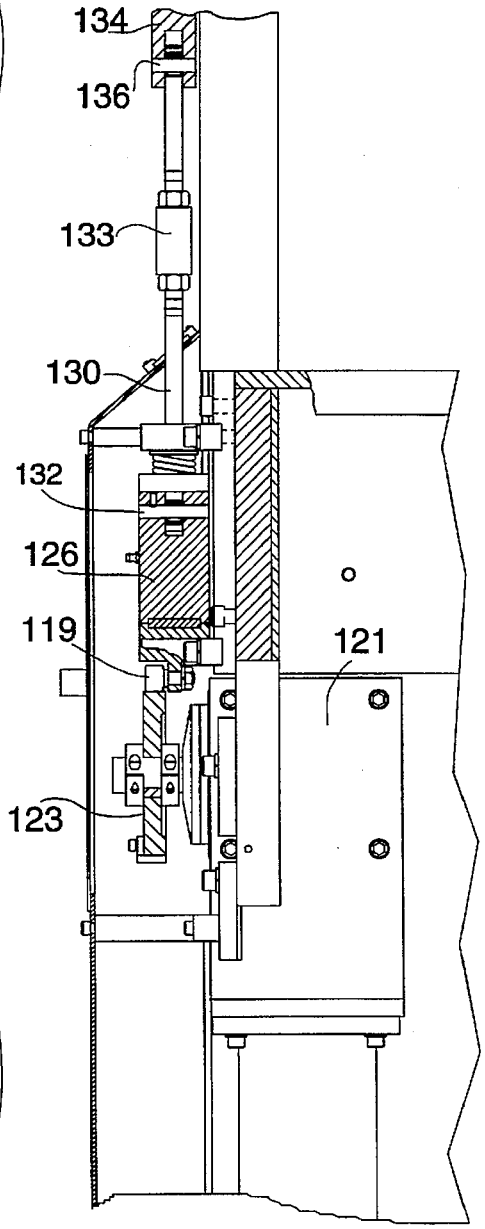
FIG. 7B is an enlarged fragmentary side view, partially in section, showing the servo motor-cam drive mechanism of FIG. 7A.

Reverting now to FIG. 2 and to FIGS. 7A and B, it will be observed that a servo motor 121 drives a cam 123 having associated follower 119 which in turn drives a slide 126 on guide rods 127, one shown. The slide 126 carries a connecting link 130 pivotally connected thereto at 132 and with an opposite end portion pivotally connected to a pivot arm 134 at 136. The arm 134 extends to and is mounted on a pivot pin 138, FIGS. 5 and 6. Pivot pin 138 is in turn carried by the slide 118 with bearing 140 providing for free pivotal movement of the arm 134 thereabout. At a forward end portion 142 the arm 134 carries the coiling tool 22.

Turnbuckle 133 provides for minor adjustments as in the precise alignment of the coiling tool with the wire feed line.

As will be apparent, operation of the servo motor 121 will result in the conversion of rotary to linear motion by the cam 123 and slide 126, movement of the slide 126 and resulting movement of the connecting link 130 and the arm 134 in one and an opposite direction. Thus, arcuate movement as indicated by the arrows 30 in FIG. 1 will result with the coiling tool being swung upwardly or downwardly in a shallow arc and in a vertical plane in a direction generally perpendicular to the line of wire feed. Such fourth "axis" movement is commonly referred to as a "torsion axis" or "torsion" movement and can be employed in the manufacture of "torsion", "belt" and "magazine" springs as well as a wide variety of other formed wire articles.

Particularly in the manufacture of "belt" and "magazine" springs, and where high rates of production are required, substantial advantage derives from the "hybrid" servo motor-cam drive mechanism. Reversal of the servo motor in moving the coiling tool in opposite directions is avoided with the result that production rates as high as four hundred (400) coils per minute have been achieved. A practical limit of about two hundred fifty (250) coils per minute is encountered with a conventional direct servo motor drive due to overheating of the servo motor resulting from high frequency reversals.

Figure 10:
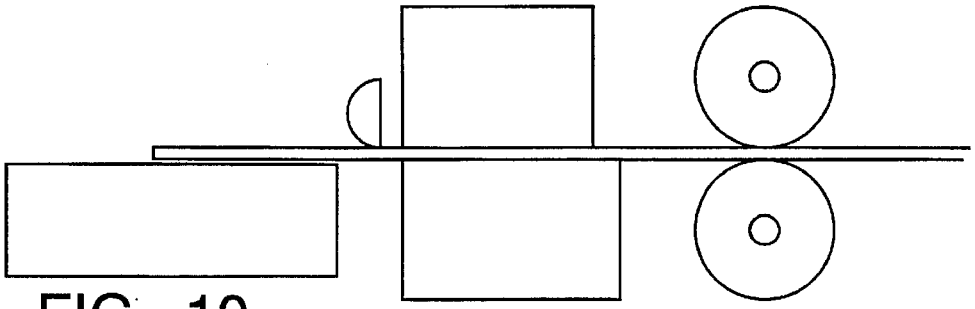
FIG. 10 is a schematic view illustrating a first stage in the manufacture of a "belt" or "magazine" spring.
Figure 10A:
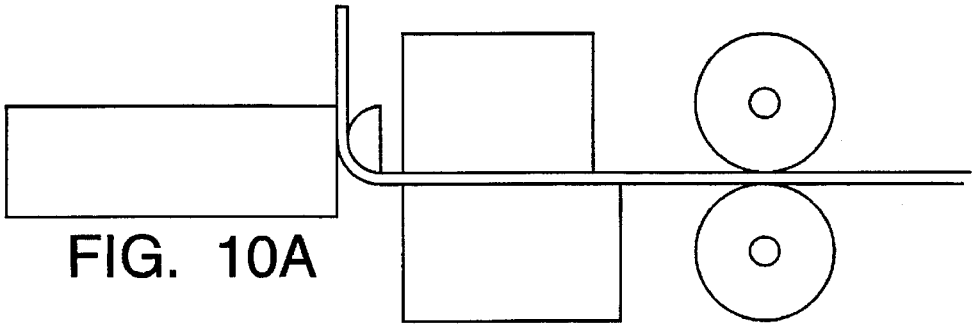
FIG. 10A is a schematic view showing a second stage in the manufacture of a "belt" or "magazine" spring.
Figure 10B:
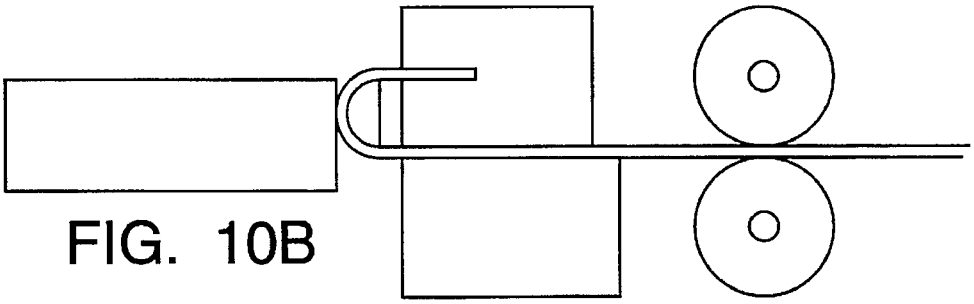
FIG. 10B is a schematic view showing a third stage in the manufacture of a "belt" or "magazine" spring.
Figure 10C:
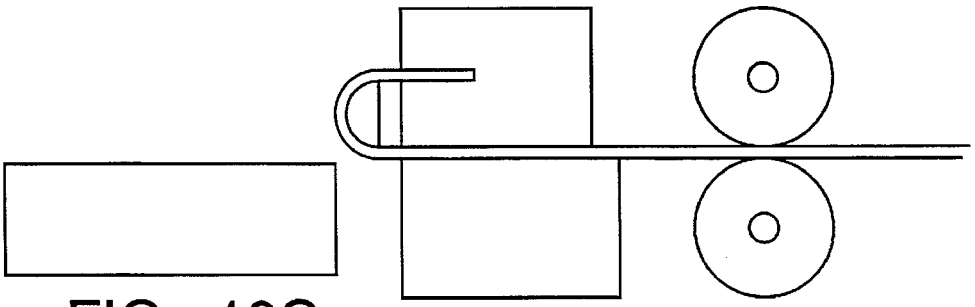
FIG. 10C is a schematic view showing a fourth stage in the manufacture of a "belt" or "magazine" spring.
Figure 10D:
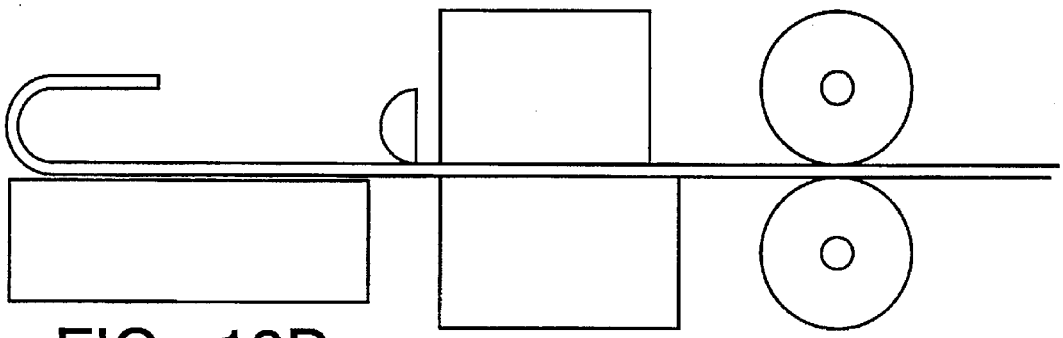
FIG. 10D is a schematic view showing a fifth stage in the manufacture of a "belt" or "magazine" spring.
Figure 10E:
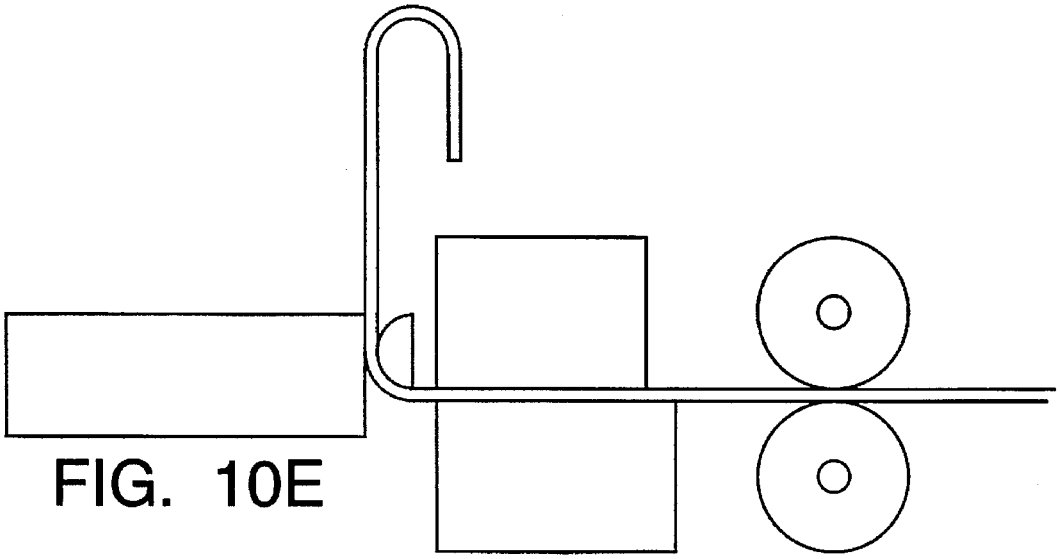
FIG. 10E is a schematic view showing a sixth stage in the manufacture of a "belt" or "magazine" spring.
Figure 10F:
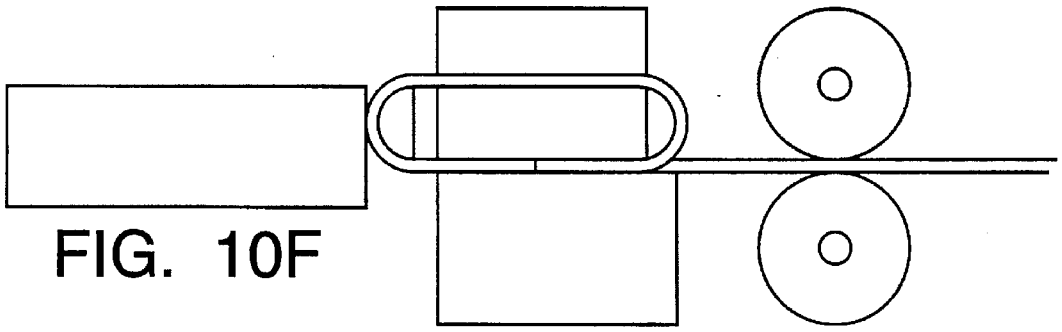
FIG. 10F is a schematic view showing a seventh stage in the manufacture of a "belt" or "magazine" spring.
Figure 16:
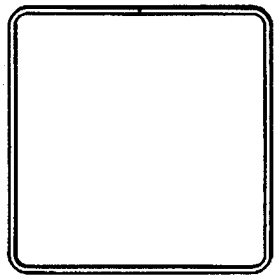
FIG. 16 is a square wire form product employing "torsion" control.
Figure 17:
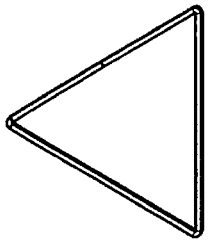
FIG. 17 is a rectangular wire form product employing "torsion" control.
Figure 18:
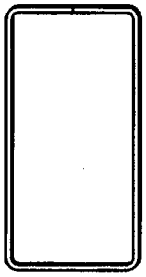
FIG. 18 is a triangular wire form product employing "torsion" control.
Figure 15:
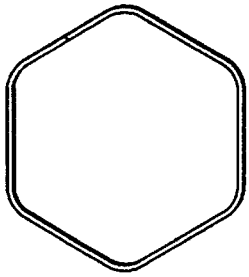
FIG. 15 is a hexagonal wire form product employing "torsion" control.
Figure 14:
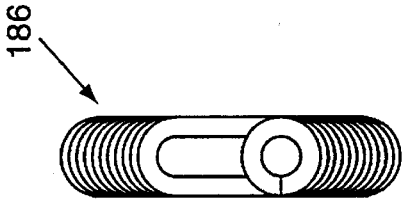
FIG. 14 is an end view of the FIG. 13 spring.
Figure 12:
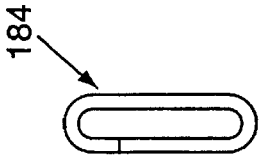
FIG. 12 is an end view of the FIG. 11 spring.
Figure 11:
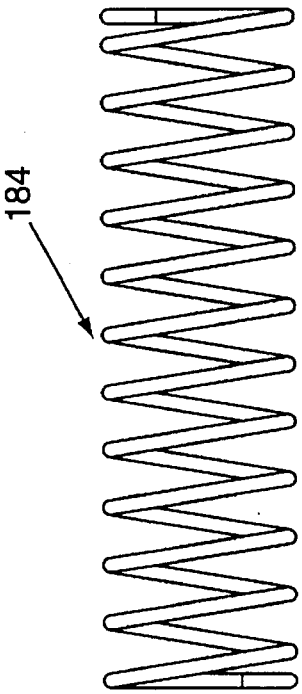
FIG. 11 is a side view illustrating a "belt" or "magazine" spring formed with opposing linear side portions in each coil and employing "torsion" control.
Figure 13:
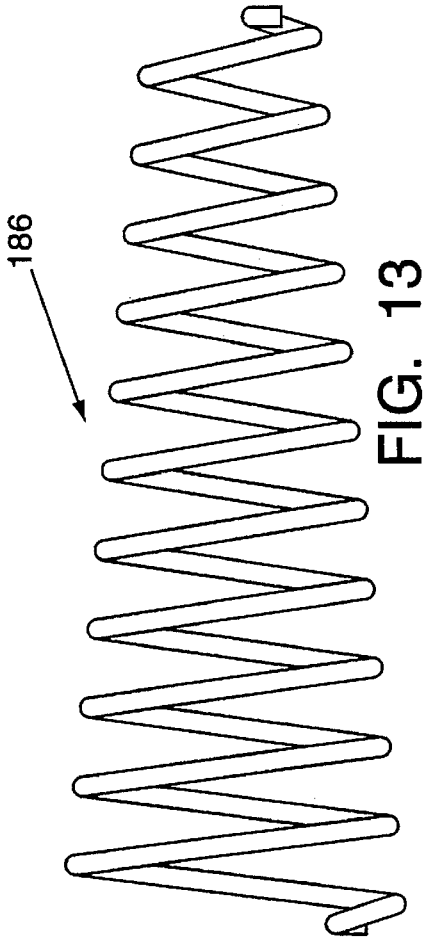
FIG. 13 illustrates a tapered spring employing diameter control and also employing torsion control resulting in linear side portions of the spring.

FIG. 10 through 10F illustrate the various stages in the formation of a "belt" or "magazine" spring, of the type shown in FIGS. 11 through 14. As will be apparent, four (4) reversals of a servo motor in a direct drive mechanism would be required in the manufacture of a single coil, the coiling tool being twice moved to and away from its coiling position. On the other hand, unidirectional operation of the servo motor absent attendant overheating is provided for with the incorporation of the cam 123.

FIGS. 15 through 18 illustrate additional straight sided formed wire products which may be advantageously manufactured at high rates of production with the servo motor-cam drive mechanism of the present invention.

Fifth "axis" movement and control is provided for by a servo motor 146 mounted rearwardly of the coiling machine and having a universal connection at 148 with a shaft 150 which also has a universal connection 152 with a preloaded ball screw mechanism 154. Linear output element 156 of the ball screw mechanism 154 is mounted for front to rear lateral sliding movement within a guide member 158, FIGS. 6 and 7. At a front end portion, the member 156 has a coiling tool holder 160 fixedly supported thereon with the latter in turn supporting the coiling tool 22.

As will be apparent, the servo motor 146 may be operated to in turn operate the shaft 150, the ball screw mechanism 154 and the drive element 156 in turn moving the coiling tool 22 forwardly and rearwardly in FIGS. 6 and 7 as required for "lateral coiling point" or fifth "axis" movement. The direction of movement is perpendicular to the line of wire feed and also substantially perpendicular to the aforementioned fourth "axis" or torsion movement. Coordination of fourth and fifth axis movement is provided for and is accommodated by the shaft 150 and the associated universal joints 148 and 152.

Referring to FIG. 7 a servo motor 162 is also provided at a rear portion of the coiling machine behind the frame 50 and has an associated ball screw mechanism 163. The mechanism 163 in turn operates a linearly moveable rod 164 adjustably connected with a second rod 166 which carries the aforementioned pitch tool 26 at a front end portion thereof.

As will be apparent, the aforementioned third "axis" movement is achieved by the servo motor 162, the conversion mechanism 163, and rods 164,166 to provide for the required lateral movement of the pitch tool 26 as described above.

Figure 8:
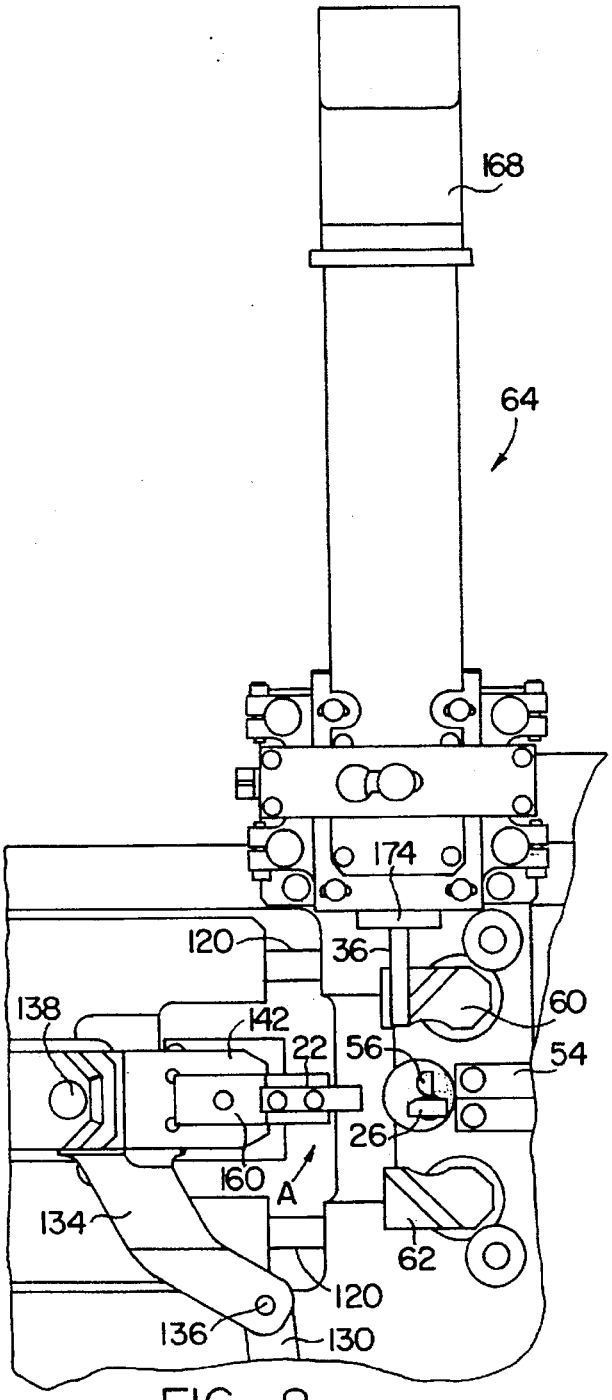
FIG. 8 is an enlarged fragmentary front view showing an auxiliary arbor at a coiling station in relation to a coiling tool.
Figure 9:
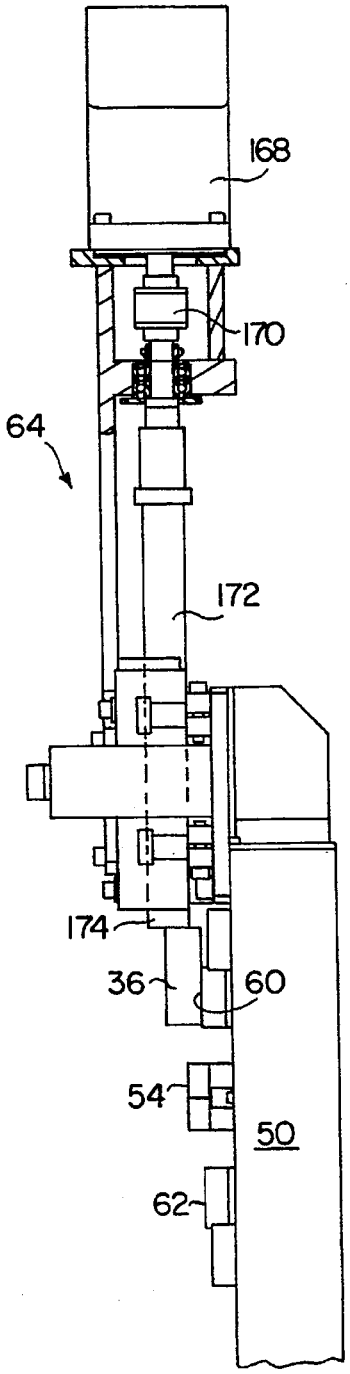
FIG. 9 is an enlarged fragmentary side elevational view showing the auxiliary arbor.

The seventh "axis" movement of auxiliary arbor 36 is illustrated in FIGS. 8 and 9. Arbor 36 is moveable vertically relative to wire at the coiling station A as described above. Servo motor 168 has an associated coupling 170 and a preloaded ball screw mechanism 172 for conversion from rotary to linear movement. An output member 174 of the mechanism 172 carries the auxiliary arbor 36 and moves the same from the elevated and inoperative position shown in FIGS. 8 and 9 to a lower operative position in FIG. 1A laterally adjacent wire at the coiling station. The several operating positions 42, 44, 46 along the length of the arbor 36 are effected by the servo motor as required under the control of an associated microprocessor for the provision of desired bending operations.

From the foregoing it will be apparent that a high degree of efficiency has been provided for in the high volume production of springs and the like requiring high frequency "torsion" movement and control of the coiling tool. A number of spring and wire form configurations can thus be manufactured with operation of the machine substantially exceeding prior art machines in speed, efficiency and accuracy of operation.

We claim:

1. In a cyclically operable spring coiling machine having a coiling station, a feed roll assembly comprising at least one pair of oppositely rotatable feed rolls for cooperatively gripping wire therebetween and for advancing the same longitudinally to the coiling station, at least one coiling tool at the coiling station arranged to engage longitudinally advancing wire and to obstruct the linear movement thereof whereby progressively to bend the same and to thus impart a coiling stress thereto resulting in the formation of a spring at a leading end portion thereof, at least one cut-off tool at said coiling station operable intermittently to sever leading end portions of the wire whereby to provide individual springs;

the improvement comprising providing a torsion drive mechanism for the coiling tool comprising a servo motor rotating a cam having a contour in turn driving a slide and linkage means for moving the coiling tool to and away from a coiling position substantially aligned with the wire feed line, said servo motor and cam being operatively associated to provide for unidirectional motor and cam operation with high frequency reversal of coiling tool movement resulting from the cam contour.

2. A cyclically operable spring coiling machine as set forth in claim 1 wherein a link pivotally connected with the slide and also pivotally connected with a swingable arm arcuately moves said coiling tool to and away from its coiling position.

3. A cyclically operable spring coiling machine as set forth in claim 1 wherein a turnbuckle is provided intermediate the pivot connections of said link for adjustment of the coiling tool position relative to the line of wire feed.

4. In a cyclically operable spring coiling machine having a coiling station; the combination of a feed roll assembly comprising at least one pair of oppositely rotatable feed rolls for cooperatively gripping wire therebetween and for advancing the same longitudinally to the coiling station, at least one coiling tool at the coiling station arranged to engage longitudinally advancing wire and to obstruct the linear movement thereof whereby progressively to bend the same and thus to impart a coiling stress thereto resulting in the formation of a spring at a leading end portion thereof, said coiling tool being mounted for movement generally toward and away and substantially along a forwardly extended wire feed line, a servo motor for controlling the movement of said coiling tool, at least one cut off tool at said coiling station operable intermittently to sever leading end portions of the wire whereby to provide individual springs, and a torsion drive mechanism for the coiling tool comprising a servo motor, cam and slide for moving the coiling tool to and away from a coiling position substantially aligned with the wire feed line.

5. A cyclically operable spring coiling machine as set forth in claim 4 and including a pitch tool at the coiling station engageable with and operable during longitudinal wire advancement to displace the wire laterally, said pitch tool being mounted for movement in a direction generally perpendicular to the line of wire advancement, and also including a servo motor for controlling the movement of said pitch tool.

6. A cyclically operable spring coiling machine as set forth in claim 5 wherein said coiling tool is mounted for movement in two directions generally perpendicular to each other and both generally perpendicular to said wire feed line, one of said movements being said "torsion" movement, and wherein an additional servo motor is provided for controlling movement of the coiling tool generally perpendicularly to said wire feed line respectively in one of said two directions.

7. A cyclically operable spring coiling machine as set forth in claim 6 wherein said two perpendicular directions of movement of said cooling tool are respectively substantially perpendicular to and parallel with the axis of a coil spring formed at the coiling station.

8. A cyclically operable spring coiling machine as set forth in claim 6 and including an auxiliary arbor movable between inoperative and operative positions in a direction generally perpendicular to but displaced slightly in a lateral direction from the line of wire feed movement, the arbor being disposed in an operative position adjacent to and on one side of a portion of wire residing along the line of wire feed movement, and the arbor thus providing lateral resistance for bending of the wire thereabout by a coiling tool disposed on an opposite side of the wire and moveable laterally across the wire line toward the arbor, and also including a servo motor for moving the arbor between its inoperative and operative positions.

9. A cyclically operable spring coiling machine as set forth in claim 8 wherein the auxiliary arbor has a plurality of operative positions along its length each with a different wire forming contour, and wherein the servo motor is operable to selectively move the arbor to said positions as required for different wire bending operations.

10. In a wire forming machine having a forming station, a feed roll assembly comprising at least one pair of oppositely rotatable feed rolls for cooperatively gripping wire therebetween and for advancing the same longitudinally to the forming station, at least one forming tool at the forming station arranged to engage longitudinally advancing wire and to progressively form the same to a desired configuration at a leading end portion thereof, at least one cut-off tool at said forming station operable intermittently to sever formed leading end portions of the wire whereby to provide individual formed wire products;

the improvement comprising providing a torsion drive mechanism for the coiling tool comprising a servo motor, cam having a contour and a slide for moving the forming tool to and away from a wire forming position substantially aligned with the wire feed line, said servo motor and cam being operatively associated to provide for unidirectional motor and cam operation with high frequency reversal of forming tool movement resulting from the cam contour.

11. A wire forming machine as set forth in claim 10 wherein a link is pivotally connected with said slide and with a swingable arm for arcuately moving said coiling tool to and away from its coiling position.

12. A wire forming machine as set forth in claim 10 wherein the feed roll assembly is mounted for rotation about the axis of wire advanced by the feed rolls, a servo motor is provided for driving at least one of the feed rolls and is supported by, rotatable with, and forms a part of the feed roll assembly, and wherein a stationary servo motor is provided for bodily rotating the feed roll assembly in timed relationship with the advancement of wire and the formation of coil springs and the like.

13. A wire forming machine as set forth in claim 11 wherein a turnbuckle is provided intermediate the pivot connections of said link for arcuate adjustment of the coiling tool position relative to the line of wire feed.

14. A wire forming machine as set forth in claim 12 wherein two (2) pairs of feed rolls are provided in adjacent relationship with at least one roll of each pair driven by said servo motor and with at least one roll of each pair having an associated fluid cylinder means for urging the same in a generally perpendicular direction relative to the line of wire feed for gripping and releasing wire.

15. A wire forming machine as set forth in claim 14 wherein a gear means is provided to be driven by the servo motor and to in turn drive all four feed rolls in unison with opposing feed rolls rotating in opposite directions.

16. A wire forming machine as set forth in claim 15 wherein at least one guide means is provided on said feed roll assembly for passage of the wire therethrough in association with said feed rolls.

* * * * *